US005830243A

United States Patent [19]

Wolak et al.

[11] Patent Number: 5,830,243

[45] Date of Patent: Nov. 3, 1998

[54] FUEL COMPOSITIONS CONTAINING N-SUBSTITUTED PERAHYDRO-S TRIAZINES

[75] Inventors: Thomas J. Wolak, Mentor; Daniel T. Daly, Solon; Kurt F. Wollenberg, Chardon; William D. Abraham, South Euclid; Paul E. Adams, Willoughby Hills; Mitchell M. Jackson, Chagrin Falls, all of Ohio

[73] Assignee: The Lubrizol Corporation, Wickliffe, Ohio

[21] Appl. No.: 927,734

[22] Filed: Sep. 11, 1997

[51] Int. Cl.[6] ..... C10L 1/22

[52] U.S. Cl. ..... 44/336; 544/215

[58] Field of Search ..... 44/336; 544/215

[56] References Cited

U.S. PATENT DOCUMENTS

| | | | |
|---|---|---|---|
| 2,701,187 | 2/1955 | Andress | 44/63 |
| 2,852,354 | 9/1958 | Schubert et al. | 44/63 |
| 3,158,450 | 11/1964 | D'Alelio | 44/63 |
| 3,791,974 | 2/1974 | Borchert | 252/49.5 |
| 3,818,006 | 6/1974 | Klemchuk | 44/336 |
| 3,864,098 | 2/1975 | Honnen | 44/58 |
| 3,915,970 | 10/1975 | Limaye et al. | 260/248 NS |
| 4,308,031 | 12/1981 | Au | 544/215 |
| 4,605,737 | 8/1986 | Au | 544/215 |
| 4,609,379 | 9/1986 | Kitchen, III | 44/336 |
| 5,089,029 | 2/1992 | Hashimoto et al. | 44/432 |
| 5,162,049 | 11/1992 | Bostick | 44/336 |
| 5,215,547 | 6/1993 | Bostick et al. | 44/336 |

OTHER PUBLICATIONS

Chemical Abstracts: 89:108404.

*Primary Examiner*—Jacqueline V. Howard
*Attorney, Agent, or Firm*—Krishna G. Banerjee; David M. Shold

[57] ABSTRACT

The present invention is directed to a composition made by reacting A) an aldehyde of 1 to 12 carbon atoms or a reactive equivalent thereof; and B) at least one etheramine represented by the formula $$R^2[O(CH_2CH(R)O)_n—R^1—NH_2]_y \quad (I)$$

wherein each n is a number from 0 to about 50; each R is selected from the group consisting of hydrogen, hydrocarbyl groups of 1 to about 16 carbon atoms, and mixtures thereof; each $R^1$ is selected from the group consisting of a hydrocarbylene group containing 2 to about 18 carbon atoms and a group represented by the formula $$—(R^6\underset{\underset{H}{|}}{N})_p—R^7—$$

wherein both $R^6$ and $R^7$ are hydrocarbylene groups of about 3 to about 10 carbon atoms and p is a number from 1 to 4; y is 1, 2, or 3; and each $R^2$ is a hydrocarbyl group having a valence of y and containing 1 to about 50 carbon atoms when y is 1 and 1 to about 18 carbon atoms when y is 2 or 3; y is 1, 2, or 3; provided that when n is zero, y is 1.

The reaction product can include a N-substituted perhydro-s-triazine represented by the formula

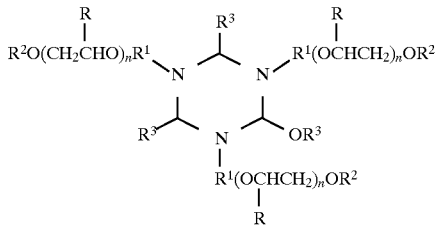

Fuel additives containing these compositions are useful in reducing intake valve deposit and do not contribute to the increase in combustion chamber deposit in port fuel injected engines.

30 Claims, No Drawings

FUEL COMPOSITIONS CONTAINING N-SUBSTITUTED PERAHYDRO-S TRIAZINES

BACKGROUND OF THE INVENTION

1. Field of the Invention

This invention relates to novel N-substituted perhydro-s-triazine compounds and to fuel compositions containing them. The fuel compositions are effective for reducing deposit formation in port fuel injected engines.

2. Description of Related Art

It is well known to those skilled in the art that internal combustion engines form deposits on the surface of engine components, such as carburetor ports, throttle bodies, fuel injectors, intake ports, and intake valves, due to the oxidation and polymerization of hydrocarbon fuel. Deposits also form in the combustion chamber of an internal combustion engine as a result of incomplete combustion of the mixture of air, fuel, and oil. These deposits, even when present in relatively minor amounts, often cause noticeable driving problems, such as stalling and poor acceleration. Moreover, engine deposits can significantly increase an automobile's fuel consumption and production of exhaust pollutants. Specifically, when the gasoline used in a given engine is of a constant octane number, the power output decreases when deposits are formed. In order to maintain the power output at a predetermined desired level, it then becomes necessary to increase the octane number of the fuel over the course of time. This Octane Requirement Increase (ORI) is undesirable. Therefore, the development of effective fuel detergents or deposit control additives to prevent or control such deposits is of considerable importance, and numerous such materials are known in the art.

Two general classes of additives are commercially known. One class comprises hydrocarbyl-substituted amines such as those prepared by reacting olefins and olefin polymers with amines (including polyamines). Typical examples of this class are polybutenyl amines. Another class of additives comprises the polyetheramines. Usually, these are "single molecule" additives, incorporating both amine and polyether functionalities within the same molecule. A typical example is a carbamate product comprising repeating butylene oxide units under the trade name "Techron™" marketed by the Oronite Division of Chevron Chemical Company.

In some cases, the polyetheramines are preferred as the oxygenation (from the polyether functionality) is thought to lower particulate matter and nitrogen oxide (NOx) emissions and combustion chamber deposits. In addition, polyetheramines require little or no additional fluidizer oil to pass certain industry mandated valve stick requirements, resulting in a more economical final package. Polyisobutenyl amines, on the other hand, do require the addition of fluidizer oil to pass valve stick requirements and in addition are perceived to cause higher combustion chamber deposits than the fuel alone.

U.S. Pat. No. 3,915,970, Limaye et al., Oct. 28, 1975, discloses a compound having the formula

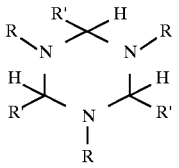

wherein R is hydrogen or alkyl having one to four carbon atoms, and R is $HOC_mH_{2m}$—[—$OC_nH_{2n}$]p—, alkyl having one to four carbon atoms, cyclohexyl or cyclopentyl, with the proviso that at least one R is $HOC_mH_{2m}$—[—$OC_nH_{2n}$]p—wherein m, n, and p are integers from 1 to 6. The compound, a N-substituted perhydro-s-triazine, which is the condensation product of an aldehyde and an ether-amine, is disclosed to be a biocide which is particularly effective against the microbes which attack hydrocarbon fractions in the presence of water, the amount of which may be very small. The biocide is disclosed to be especially useful as an additive in cutting or soluble oil emulsions to mitigate their degradation by micro-organisms.

U.S. Pat. No. 4,605,737, Aug. 12, 1986 discloses N-substituted perhydro-s-triazines corresponding to the formula

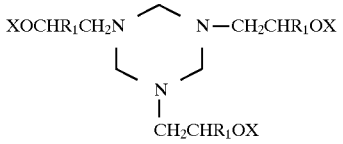

wherein $R_1$ is hydrogen, methyl or ethyl; and X is hydrogen, —$CH_2CHR_1O)_nR$ or —(O)R, where n is a number from zero to about 4, and R is alkyl, cycloalkyl, alkenyl or aryl of up to about 30 carbons, provided that in at least on one occurrence, X is —C(O)R. The compounds have been found to be effective corrosion inhibitors for acid containing fluids. They have also been disclosed to be useful as emulsifiers, lubricants and hydraulic fluids.

U.S. Pat. No. 3,791,974, Borchert, Feb. 12, 1974, discloses that metal working compositions used to cool and lubricate metal in cutting, grinding, rolling, drawing, and similar metal working operations are protected against bacterial spoilage during use by the presence of 10 to 3000 ppm of a triazine compound of the formula

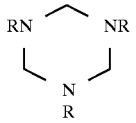

wherein R is $$—CH_2)_n—O—(CH_2)_m—CH_3$$

where n is the number 2 or 3, and m is the number 0, 1, 2 or 3.

SUMMARY OF THE INVENTION

The present invention discloses a composition comprising the reaction product of:

A) an aldehyde of 1 to 12 carbon atoms or a reactive equivalent thereof; and

B) at least one etheramine represented by the formula $$R^2[O(CH_2CH(R)O)_n—R^1—NH_2]_y \quad (I)$$

wherein each n is a number from 0 to 50; each R is selected from the group consisting of hydrogen, hydrocarbyl groups of 1 to 16 carbon atoms, and mixtures thereof; each $R^1$ is selected from the group consisting of a hydrocarbylene group containing 2 to 18 carbon atoms and a group represented by the formula $$-(R^6N)_p-R^7-$$
$$\quad\;\; |$$
$$\quad\;\; H$$

wherein both $R^6$ and $R^7$ are hydrocarbylene groups of about 3 to 10 carbon atoms and p is a number from 1 to 4; y is 1, 2, or 3; and each $R^2$ is a hydrocarbyl group having a valence of y and containing 1 to 50 carbon atoms when y is 1 and 1 to 18 carbon atoms when y is 2 or 3; provided that when n is zero, y is 1.

The reaction product can comprise a N-substituted perhydro-s-triazine represented by the formula

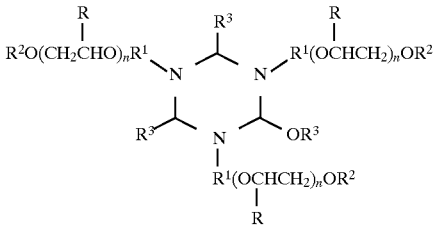

wherein each n, R, $R^1$ and $R^3$ are defined as above, and each $R^2$ is a hydrocarbyl group containing 1 to about 50 carbon atoms.

Also disclosed are fuel additives comprising said reaction product of the aldehyde and the etheramine.

DETAILED DESCRIPTION OF THE INVENTION

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

As used herein, the word "triazine" refers specifically to a N-substituted perhydro-s-triazine. Although in some instances in this Application, the complete name has been used (i.e. N-substituted perhydro-s-triazine), in others, only the word "triazine" has been used for the sake of brevity.

The composition of the present invention comprise the reaction product of:

A) an aldehyde of 1 to 12 carbon atoms or a reactive equivalent thereof; and

B) at least one etheramine represented by the formula $$R^2[O(CH_2CH(R)O)_n-R^1-NH_2]_y \qquad (I)$$

wherein each n is a number from 0 to 50; each R is selected from the group consisting of hydrogen, hydrocarbyl groups of 1 to 16 carbon atoms, and mixtures thereof; each $R^1$ is selected from the group consisting of a hydrocarbylene group containing 2 to 18 carbon atoms and a group represented by the formula $$-(R^6N)_p-R^7-$$
$$\quad\;\; |$$
$$\quad\;\; H$$

wherein both $R^6$ and $R^7$ are hydrocarbylene groups of 3 to 10 carbon atoms and p is a number from 1 to 4; y is 1, 2, or 3; and each $R^2$ is a hydrocarbyl group having a valence of y and containing 1 to 50 carbon atoms when y is 1 and 1 to 18 carbon atoms when y is 2 or 3; y is 1, 2, or 3; provided that when n is zero, y is 1.

The Aldehyde

The aldehydes used to make the composition of this invention will have 1 to 12 carbon atoms. Suitable aldehydes include formaldehyde, benzaldehyde, acetaldehyde, the butyraldehydes, and heptanals. Reactive equivalents of aldehydes are also included as suitable reactants. The phrase "reactive equivalent" of a material, means any compound or chemical composition other than the material itself which reacts like the material itself under the reaction conditions. Examples of reactive equivalents of formaldehyde include paraformaldehyde, paraldehyde, formalin (an aqueous solution of formaldehyde) and methal. Formaldehyde and its precursors and reaction synthons (i.e., synthetic equivalents, e.g., paraformaldehyde, trioxane) are the preferred aldehydes used to make the product of the present composition. Mixtures of aldehydes may also be used as reactants for the composition.

The Etheramine

The etheramine used to the make the composition of this invention can be represented by the formula $$R^2[O(CH_2CH(R)(O)_n-R^1-NH_2]_y$$

wherein each n is a number from 0 to 50; each R is selected from the group consisting of hydrogen, hydrocarbyl groups of 1 to 16 carbon atoms, and mixtures thereof; each $R^1$ is selected from the group consisting of a hydrocarbylene group containing 2 to 18 carbon atoms and a group represented by the formula $$-R^6N)_p-R^7-$$

wherein both $R^6$ and $R^7$ are hydrocarbylene groups of 3 to 10 carbon atoms and p is a number from 1 to 4; and each $R^2$ is a hydrocarbyl group having a valence of y where y is a number from 1 to 3, and containing 1 to 50 carbon atoms when y is 1 and 1 to 18 carbon atoms when y is 2 or 3; provided that when n is zero, y is 1.

The etheramine includes a mono ether amine, wherein n in the above formula is zero, as well as a polyetheramine, wherein n in the above formula is at least one.

The etheramines can include up to three primary amine functionalities (i.e., y in the above formula can have values of 1, 2, or 3), as well as compounds having a primary and secondary amine functionality in the same molecule.

The etheramines having one primary amino group include those where $R^1$ in the above formula is a hydrocarbylene group, so that the etheramine is represented by the formula $$R^2O(CH_2CH(R)(O)_nR^1NH_2 \quad (II)$$

wherein $R^2$ is a hydrocarbyl group having 1 to 50 carbon atoms; and n and R and $R^1$ are defined as above. Preferably R is methyl, ethyl, or mixtures thereof. These correspond to the etheramine having propylene oxide (PO) or butylene oxide (BO) repeat units which are more soluble in gasoline than etheramines having ethylene oxide repeat units, although etheramines having mixtures of ethylene oxide (EO) and higher alkylene oxide repeat units are also contemplated for use in the fuel compositions of this invention.

One type of etheramines having one primary amine functionality and fitting the above structural general formula (II) are etheramines represented by the formula $$R^2O(CH_2CH(R)(O)_nCH_2CH(R)NH_2 \quad (III)$$

where R and $R^2$ are defined as above and n is 1 to 50. These etheramines are prepared by reaction of a monohydric alcohol initiator with an alkylene oxide where R and $R^2$ are defined as above and n is 1 to 50. These etheramines are prepared by reaction of a monohydric alcohol initiator with an alkylene oxide (typically EO, PO, or BO followed by conversion of the resulting terminal hydroxyl group to an amine. Examples of these include the commercial JEFFAMINE™ M-Series of polyetheramines, manufactured by Huntsman Chemical company, which are prepared using ethylene and/or propylene oxide, and have terminal —$CH_2CH(CH_3)NH_2$ group. Among these JEFFAMINE™ M-600 and M-2005 are predominantly PO based having a mole ratio of PO/EO of approximately 9/1 and 32/3 respectively. These will typically have greater solubility in the hydrocarbon fuels than polyetheramines having higher concentration of EO units in the chain.

Examples of polyetheramines wherein $R^2$ is nonylphenyl include the SURFONAMINE™ series of surface active amines, manufactured by Huntsman Chemical Company. The series consist of amines with the general structure $$R^2—OCH_2CH_2)_x—OCH_2CH(CH_3))_y—NH_2$$

wherein $R^2$ is p-nonylphenyl, and the x/y ratio ranges from 1/2 to 12/2 as well as products containing only PO units.

Polyetheramines which are end capped with one or a few units of EO are also useful. Thus the etheramine can be represented by the formula $$R^2O(CH_2CH(CH_3)O)_{10-30}(CH_2CH_2O)_{1-5}CH_2CH_2NH_2 \quad (IV)$$

wherein $R^2$ is a hydrocarbyl group of 10 to 20 carbon atoms.

Another useful class of etheramines are those represented by the formula $$R^2O(CH_2CH(R)(O)_n[(CH_2)_3NH]_qH \quad (V)$$

wherein q is number from 1 to 5; n is number from 0 to 50; and R and $R^2$ are defined as above. These can usually be prepared by cyanoethylating an adduct of an alcohol, or alkylphenol and an alkylene oxide with acrylonitrile and hydrogenating the obtained product, and, if necessary, followed by the repetition of the cyanoethylation and the hydrogenation steps. The cyanoethylation is typically conducted by stirring the reaction system under heating in the presence of a strong base catalyst such as caustic alkali. The hydrogenation can be conducted in the presence of a hydrogenation catalyst such as Raney nickel. In one embodiment, $R^2$ in the above formula is an alkyl group of 12 to 15 carbon atoms, R is methyl and q is 1.

In one embodiment the etheramine of formula (V) is represented more specifically by the formula $$R^2O(CH_2CH(R)O)_n(CH_2)_3NH_2 \quad (VI)$$

In one embodiment, n is about 22 to about 27, and the polyetheramine is derived from a commercial polyether ("Dalcol™-21"; Arco Chemical Company) through the aforementioned cyanoethylation/hydrogenation steps.

When n in the above formula is zero, the etheramine is a monoetheramine. Examples of monoetheramines of the above formula include the commercial amines produced and marketed by Tomah Products, Inc. These etheramines are represented by the formula $R^2OR^1NH_2$ where $R^1$ is an alkylene group of 2 to 6 carbon atoms, and $R^2$ is defined as above. These primary ether amines are generally prepared by the reaction of an alcohol $R^2OH$ with an unsaturated nitrile. The nitrile reactant can have from 2 to 6 carbon atoms with acrylonitrile being most preferred. When acrylonitrile is used, the monoetheramine is represented by the formula $R^2O(CH_2)_3NH_2$. Typical of such etheramines are those having from 150 to 400 molecular weights.

In one embodiment, the monoetheramine is isotridecyloxypropylamine ($C_{13}H_{27}O(CH_2)_3NH_2$), available commercially from Tomah as "PA-17".

Examples of monoetheramines of the above formula wherein n is zero and q is 2 are ether diamines represented by the formula $R^2O(CH_2)_3NH(CH_2)_3NH_2$ and manufactured by Tomah Products, Inc. Specific examples include isotridecyloxypropyl-1,3 diamino propane ("DA-17") and Octyl/decyloxypropyl-1,3-diamino propane ("DA-1214") containing mixed alkyl groups.

Etheramines having two or three primary amine functionalities include the JEFFAMINE™ diamines and triamines respectively manufactured by Huntman Chemical Company.

The JEFFAMINE™ diamines include the D-series represented by the structure $$H_2NCH(CH_3)CH_2—[OCH_2CH(CH_3)]_x—NH_2 \quad (VII)$$

wherein x ranges from 2 to 66, with molecular weights ranging from 230 to 4000.

The JEFFAMINE™ triamines include the JEFFAMINE™ T-Series which are PO based triamines and are prepared by reaction of a PO with a triol initiator, followed by amination of the terminal hydroxyl groups. They are represented by the structure

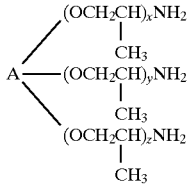

(VIII)

wherein A is a triol initiator and x, y, and z represent the number of repeat units of propylene oxide. The values of x, y, and z are such that the molecular weight of the triamine ranges from 440 to 5000. An example of a triol initiator is glycerol.

Mixtures of etheramines, including mixtures of different monoetheramines, a monoetheramine and a polyetheramine and different polyetheramines can be used in the reaction with the aldehyde and are within the scope of this invention.

In one embodiment, the etheramine of this invention is a mixture comprising two etheramines:

(a) a monoetheramine represented by the formula $R^2OR^1NH_2$ wherein $R^1$ is a hydrocarbylene group of 2 to 5 carbon atoms; and $R^2$ is a hydrocarbyl group of 12 to 15 carbon atoms.

(b) a polyetheramine represented by the formula $R^2O(CH_2CH(R)O)_n(CH_2)_3NH_2$ wherein n is 1 to 50; R is methyl; and $R^2$ is a hydrocarbyl group of 10 to 18 carbon atoms. In one preferred embodiment, the mole ratio of (a):(b) is 1.8:1 to 2.2:1. In another preferred embodiment, the mole ratio is 1:1.8 to 1:2.2.

When the etheramine has one primary amine functionality (i.e., y in formula (I) is 1), it normally reacts with the aldehyde to form a N-substituted perhydro-s-triazine represented by the structure

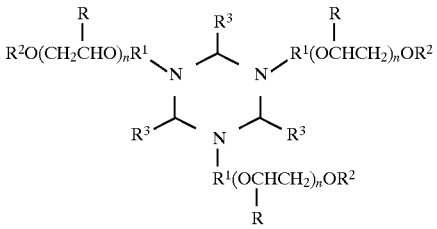

(IX)

wherein each n is a number from 0 to 50; each R is selected from the group consisting of hydrogen, hydrocarbyl groups of 1 to 16 carbon atoms, and mixtures thereof; each $R^1$ is selected from the group consisting of a hydrocarbylene group containing 2 to 18 carbon atoms and a group represented by the formula

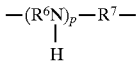

wherein both $R^6$ and $R^7$ are hydrocarbylene groups of 3 to 10 carbon atoms and p is a number from 1 to 4; each $R^2$ is a hydrocarbyl group containing 1 to 50 carbon atoms; and each $R^3$ is a hydrogen or a hydrocarbyl group of 1 to 11 carbon atoms.

When the etheramine has one primary and one secondary amine functionalities, such as those of the formula V, wherein R is methyl, and q is 2, the products of the reaction also comprise a N-substituted perhydro-s-triazine; however the triazine is typically a minor component of the product mixture. The major component of the product mixture comprises compositions formed by intramolecular cyclization.

When the etheramine has two or three primary amine functionalities, (i.e., y in formula (I) is 2 or 3) the products are usually crosslinked materials which presumably comprise a network type of structure wherein almost every amine functionality is part of a triazine ring. What results is an interconnected network of 6-membered triazine nuclei.

Typically, the reactants used (etheramine and formaldehyde) for the preparation of the triazine are usually present in 1:1 molar proportions. This is also the most preferred ratio. However mole ratios of reactants more enriched in the etheramine will also result in production of the triazine. Thus mole ratios of aldehyde to etheramine ranging from 1:0.8 to 1:2.2 will also result in the formation of triazine.

The fuel compositions of the present invention comprise a major portion of a liquid fuel boiling in the gasoline boiling range as well as a portion of an additive. The term "major portion" indicates that preferably at least 95% or more preferably at least 99% of the fuel composition will comprise a liquid fuel boiling in the gasoline range.

The liquid fuels of this invention are well known to those skilled in the art and usually contain a major portion of a normally liquid fuel such as hydrocarbonaceous petroleum distillate fuel (e.g., motor gasoline as defined by ASTM Specifications D-439-89) and fuels containing non-hydrocarbonaceous materials such as alcohols, ethers, and organo-nitro compounds (e.g., methanol, ethanol, diethyl ether, methyl ethyl ether, nitromethane).

Oxygen containing molecules (oxygenates) are compounds covering a range of alcohol and ether type compounds. They have been recognized as means for increasing octane value of a base fuel. They have also been used as the sole fuel component, but more often as a supplemental fuel used together with, for example, gasoline, to form the well-known "gasohol" blend fuels. Oxygenated fuel (i.e. fuels containing oxygen-containing molecules) are described in ASTM D-4814-91. The oxygenated fuel of this invention will typically comprise up to 25% by weight of one or more oxygen-containing molecules.

Methanol and ethanol are the most commonly used oxygen-containing molecules. Other oxygen-containing molecules, such as ethers, for example methyl-t-butyl ether, are more often used as octane number enhancers for gasoline.

Particularly preferred liquid fuels are gasoline, that is, a mixture of hydrocarbons having an ASTM boiling point of 60° C. at the 10% distillation point to about 205° C. at the 90% distillation point, oxygenates, and gasoline-oxygenate blends, all as defined in the aforementioned ASTM Specifications for automotive gasolines. Most preferred is gasoline.

The fuel additive of this invention comprises the reaction product of the aldehyde and the etheramine, as described hereinbefore in the specification.

Treating levels of the additives used in this invention are often described in terms of parts per million (by weight) (PPM) or pounds per thousand barrels (PTB) of fuel. The PTB values may be multiplied by four to approximately convert the number to PPM.

The fuel additive is present at a level of 10 to 5000 parts per million (PPM), preferably 50 to 2000 PPM, and more preferably 100 to 500 PPM based on the total fuel composition weight.

The motor fuel compositions of this invention contain an amount of additive sufficient to provide total intake system cleanliness. They are also used in amounts sufficient to prevent or reduce the formation of intake valve or combustion chamber deposits or to remove them where they have formed.

The fuel compositions of the present invention can contain other additives which are well known to those of skill in the art. These can include anti-knock agents such as tetra-alkyl lead compounds, lead scavengers such as haloalkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizers, metal deactivators, demulsifiers, and anti-icing agents. The fuel compositions of this invention can be lead-containing or lead-free fuels. Preferred are lead-free fuels.

EXAMPLES

Example 1

To a reactor equipped with a stirrer, thermal probe, and a Dean Stark trap with a reflux condenser, and with nitrogen flowing at 8.5 L/hr (0.3 std. $ft^3$/hr.) are charged 1290 grams (0.235 mole) of a polyetheramine (prepared by cyanoethylation, followed by reduction of a nonylphenol initiated polypropylene oxide monool, containing about 22–26 units of PO units) and 19 grams (0.235 mole) of a 37% (by weight) of formaldehyde solution in water. The mixture is heated in the reactor to about 70° C. with stirring and under nitrogen and maintained at 70° C. for 3 hours. Thereafter, the temperature is increased to 120° C., and maintained at that temperature for 3 hours, while removing water through the Dean-Stark trap. About 15 grams of distillate is collected. A diatomaceous earth filter aid (5 grams) is then charged, and the reaction mixture stirred for another 30 minutes at 120° C. The reaction mixture is filtered over additional filter aid to give the product.

Example 2

To a reactor equipped with a stirrer, thermal probe, and a Dean Stark trap with a reflux condenser, and with nitrogen flowing at 8.5 L/hr (0.3 std. $ft^3$/hr.) are charged 556 grams (0.268 mole) of a polyetheramine (prepared by cyanoethylation, followed by reduction of a polypropylene oxide monool (DALCOL™-21 from Arco Chemical Company; equivalent weight of 1650 based on hydroxyl number) and 30 grams (0.268 mole) of a 37% (by weight) solution of formaldehyde. The mixture is heated in the reactor to about 70° C. with stirring and under nitrogen and maintained at 70° C. for 3 hours. Thereafter, the temperature is increased to 120° C., and maintained at that temperature for 4 hours, while removing water through the Dean-Stark trap. About 18.6 grams of water is collected. A diatomaceous earth filter aid (5 grams) is then charged, and the reaction mixture stirred for another 30 minutes at 120° C. The reaction mixture is filtered over additional filter aid to give the product. Analysis of the product by GPC and NMR indicated the presence of triazine structure.

Example 3

To a reactor equipped with a stirrer, thermal probe, and a Dean Stark trap with a reflux condenser, and with nitrogen flowing at 8.5 L/hr (0.3 std. $ft^3$/hr.) are charged 19.8 grams (0.075 mole) of isotridecyloxypropylamine, 302 g (0.150 mole) of a polyetheramine (prepared by cyanoethylation, followed by reduction of a polypropylene oxide monool (DALCOL™-21 from Arco Chemical Company; equivalent weight of 1650 based on hydroxyl number) and 7.40 grams (0.224 mole) of paraformaldehyde. The mixture is heated in the reactor to about 95° C. with stirring and under nitrogen and maintained at that temperature for 2 hours. Thereafter, the temperature is increased to 120° C., the nitrogen sparging is increased to 28.3 L/hr (1.0 std. $ft^3$/hr.) and the reaction mixture is maintained at that temperature for 3 hours, while removing water through the Dean-Stark trap. About 4.5 grams of water is collected. A diatomaceous earth filter aid (2.5 grams) is then charged, and the reaction mixture stirred for another 30 minutes at 120° C. The reaction mixture is filtered over additional filter aid to give the product. Analysis of the product by GPC and NMR indicated the presence of triazine structure.

Example 4

To a reactor equipped with a stirrer, thermal probe, and a Dean Stark trap with a reflux condenser, and with nitrogen flowing at 8.5 L/hr (0.3 std. $ft^3$/hr.) are charged 79.9 grams (0.075 mole) of isotridecyloxypropylamine, 304 g (0.150 mole) of a polyetheramine (prepared by cyanoethylation, followed by reduction of a polypropylene oxide monool (DALCOL™-21 from Arco Chemical Company; equivalent weight of 1650 based on hydroxyl number) and 14.9 grams (0.452 mole) of paraformaldehyde. The mixture is heated in the reactor to about 95° C. with stirring and under nitrogen and maintained at that temperature for 2 hours. Thereafter, the temperature is increased to 120° C., the nitrogen sparging is increased to 28.3 L/hr (1.0 std. $ft^3$lhr.) and the reaction mixture is maintained at that temperature for 3 hours, while removing water through the Dean-Stark trap. About 8.7 grams of water is collected. A diatomaceous earth filter aid (5 grams) is then charged, and the reaction mixture stirred for another 30 minutes at 120° C. The reaction mixture is filtered over additional filter aid to give the filtrate as a product. Analysis of the product by GPC and NMR indicated the presence of triazine structure.

Example 5

To a reactor equipped with a stirrer, thermal probe, and a Dean Stark trap with a reflux condenser, and with nitrogen flowing at 8.5 L/hr (0.3 std. $ft^3$/hr.) are charged 2187 grams (1.36 mole) of a polyetheramine (prepared by cyanoethylation, followed by reduction of an ethylene oxide capped polypropylene oxide monool, initiated by nonylphenol and having an average of 19 units of propylene oxide and 1.5 units of ethylene oxide), and 44.9 grams (1.36 mole) of paraformaldehyde. The mixture is heated in the reactor to about 95° C. with stirring and under nitrogen and maintained at 95° C. for 2 hours. Thereafter, the temperature is increased to 120° C., and maintained at that temperature for 4 hours, while removing water through the Dean-Stark trap. About 25 grams of water is collected. A diatomaceous earth filter aid (10 grams) is then charged, and the reaction mixture stirred for another 30 minutes at 120° C. The reaction mixture is filtered over additional filter aid to give the filtrate as a product. Analysis of the product by GPC and NMR indicated the presence of triazine structure.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the amount, range, and ratio limits set forth herein may be combined. As used herein, the expression "consisting essentially of" permits the inclusion of substances which do not materially affect the basic and novel characteristics of the composition under consideration.

What is claimed is:

1. A composition comprising the reaction product of:

A) an aldehyde of 1 to 12 carbon atoms or a reactive equivalent thereof; and

B) at least one etheramine represented by the formula $$R^2[O(CH_2CH(R)O)_n—R^1—NH_2]_y$$

wherein each n is a number from 0 to about 50; each R independently is selected from the group consisting of hydrogen, hydrocarbyl groups of 1 to about 16 carbon atoms, and mixtures thereof; each $R^1$ independently is selected from the group consisting of a hydrocarbylene group containing 2 to about 18 carbon atoms and a nitrogen containing group represented by the formula $$—(R^6\underset{\underset{H}{|}}{N})_p—R^7—$$

wherein both $R^6$ and $R^7$ are hydrocarbylene groups of about 3 to about 10 carbon atoms and p is a number from 1to 4; y is 1, 2, or 3; and each $R^2$ independently is a hydrocarbyl group having a valence of y and containing 1 to about 50 carbon atoms when y is 1 and 1 to about 18 carbon atoms when y is 2 or 3; provided that when n is zero, y is 1: and further provided that when n is zero, $R^2$ is not an alkenyl group.

2. The composition of claim 1 wherein the etheramine is a polyetheramine and n is a number from about 10 to about 30.

3. The composition of claim 1 wherein the aldehyde is selected from the group consisting of formaldehyde, acetaldehyde, butyraldehyde and reactive equivalents thereof.

4. The composition of claim 1 wherein the etheramine is represented by the formula $$R^2O(CH_2CH(R)(O)_nCH_2CH(R)NH_2$$

wherein R, $R^2$ and n are defined as above.

5. The composition of claim 4 wherein R is methyl.

6. The composition of claim 4 wherein R is ethyl.

7. The composition of claim 5 wherein n is 1 to about 50; and $R^2$ is a hydrocarbyl group of about 10 to about 18 carbon atoms.

8. The composition of claim 5 wherein $R^2$ is nonylphenyl.

9. The composition of claim 4 wherein the etheramine is represented by the formula $$R^2O(CH_2CH(CH_3)O)_{10-30}(CH_2CH_2O)_{1-5}CH_2CH_2NH_2$$

wherein $R^2$ is a hydrocarbyl group of about 10 to about 20 carbon atoms.

10. The composition of claim 1 wherein the etheramine is represented by the formula $$R^2O(CH_2CH(R)O)_n[(CH_2)_3NH]_qH$$

wherein q is number from 1 to 5.

11. The composition of claim 10 wherein the etheramine is represented by the formula $$R^2O(CH_2CH(R)O)_{n(CH2)}{}_3NH_2$$

wherein n is 1 to about 50; R is methyl; and $R^2$ is a hydrocarbyl group of about 10 to about 18 carbon atoms.

12. The composition of claim 11 wherein n is about 20 to about 30.

13. The composition of claim 11 wherein n is about 22 to about 28; and $R^2$ is a hydrocarbyl group of about 12 to about 15 carbon atoms.

14. The composition of claim 12 wherein the mole ratio of the etheramine to the aldehyde is about 0.8:1 to about 1.2:1.

15. The composition of claim 1 wherein the etheramine is a mixture comprising:

(a) an etheramine where n is zero; $R^1$ is a hydrocarbylene group of about 2 to about 5 carbon atoms; and $R^2$ is a hydrocarbyl group of about 12 to about 15 carbon atoms; and (b) an etheramine represented by the formula $$R^2O(CH_2CH(R)O)_n(CH_2)_3NH_2$$

wherein n is 1 to about 50; R is methyl; and $R^2$ is a hydrocarbyl group of about 10 to about 18 carbon atoms.

16. The composition of claim 15 wherein the mole ratio of (a):(b) is about 3:1 to about 1:3.

17. The composition of claim 16 wherein the mole ratio of (a):(b) is about 1.8:1 to about 2.2:1.

18. The composition of claim 16 wherein the mole ratio of (a):(b) is about 1:1.8 to about 1:2.2.

19. The composition of claim 1 wherein y is 1; and the mole ratio of the aldehyde to the etheramine is from about 1:0.8 to about 1:1.2.

20. A fuel composition comprising a mixture of a major amount of hydrocarbon in the gasoline boiling range and a minor deposit reducing amount of an additive, said additive comprising the reaction product of:

A) an aldehyde of 1 to 12 carbon atoms or a reactive equivalent thereof; and

B) at least one etheramine represented by the formula $$R^2[O(CH_2CH(R)O)_n—R^1—NH_2]_y$$

wherein each n is a number from 0 to about 50; each R independently is selected from the group consisting of hydrogen, hydrocarbyl groups of 1 to about 16 carbon atoms, and mixtures thereof; each $R^1$ is selected from the group consisting of hydrocarbylene groups containing 2 to about 18 carbon atoms and nitrogen containing groups represented by the formula $$—(R^6\underset{\underset{H}{|}}{N})_p—R^7—$$

wherein both $R^6$ and $R^7$ are hydrocarbylene groups of about 3 to about 10 carbon atoms and p is a number from 1 to 4; y is 1, 2, or 3; and each $R^2$ independently is a hydrocarbyl group having a valence of y and containing 1 to about 50 carbon atoms when y is 1 and 1 to about 18 carbon atoms when y is 2 or 3; provided that when n is zero, y is 1.

21. The composition of claim 20 wherein the etheramine is represented by the formula $$R^2O(CH_2CH(R)O)_n(CH_2)_3NH_2$$

wherein n is 1 to about 50; R is methyl; and $R^2$ is a hydrocarbyl group of about 10 to about 18 carbon atoms.

22. The composition of claim 20 wherein the mole ratio of the etheramine to the aldehyde is about 0.8:1 to about 1.2:1.

23. The composition of claim 20 wherein the additive is present at a level of about 10 to about 5000 parts per million based on the total fuel composition weight.

24. The composition of claim 23 wherein the additive is present at a level of about 50 to about 2000 parts per million based on the total fuel composition weight.

25. The composition of claim 24 wherein the additive is present at a level of about 100 to about 500 parts per million based on the total fuel composition weight.

26. An N-substituted perhydro-s-triazine represented by the formula

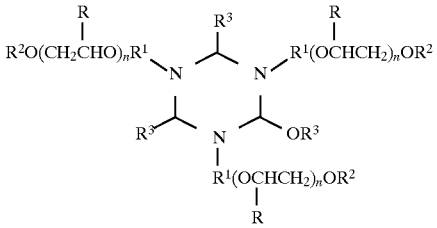

wherein each n independently is a number from 1to about 50; each R independently is a hydrocarbyl group of 1 to about 16 carbon atoms; each $R^1$ independently is selected from the group consisting of hydrocarbylene groups containing 2 to about 18 carbon atoms and nitrogen-containing groups represented by the formula

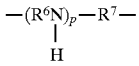

wherein both $R^6$ and $R^7$ are hydrocarbylene groups of about 3 to about 10 carbon atoms and p is a number from 1 to 4; each $R^2$ independently is a hydrocarbyl group containing 1 to about 50 carbon atoms; and each $R^3$ independently is a hydrogen or a hydrocarbyl group of 1 to 11 carbon atoms.

27. A fuel composition comprising a mixture of a major amount of hydrocarbon in the gasoline boiling range and a minor deposit reducing amount of an N-substituted perhydro-s-triazine represented by the formula

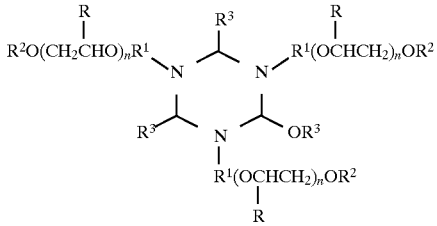

wherein each n independently is a number from 0 to about 50; each R independently is selected from the group consisting of hydrogen, hydrocarbyl groups of 1 to about 16 carbon atoms, and mixtures thereof, each $R^1$ independently is selected from the group consisting of hydrocarbylene groups containing 2 to about 18 carbon atoms and nitrogen-containing groups represented by the formula

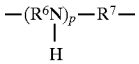

wherein both $R^6$ and $R^7$ are hydrocarbylene groups of about 3 to about 10 carbon atoms and p is a number from 1 to 4; each $R^2$ independently is a hydrocarbyl group containing 1 to about 50 carbon atoms; and each $R^3$ independently is a hydrogen or a hydrocarbyl group of 1 to 11 carbon atoms.

28. A method for reducing the intake valve or combustion chamber deposit of an internal combustion engine, comprising fueling said engine with the fuel composition of claim 1.

29. A composition prepared by admixing the components of claim 1.

30. The composition of claim 1 wherein n is a number from 1 to about 50.

* * * * *

UNITED STATES PATENT AND TRADEMARK OFFICE

CERTIFICATE OF CORRECTION

PATENT NO. : 5,830,243
DATED : November 3, 1998
INVENTOR(S) : Thomas J. Wolak et al.

It is certified that error appears in the above-identified patent and that said Letters Patent is hereby corrected as shown below:

On title page, item [54] and col. 1, line 2,
in the Title, change "Perahydro" to -- Perhydro --.

in the Abstract, in the last formula, change "$OR^{3}$" to -- $R^{3}$ --.

Column 11, line 21, replace the colon ":" after the phrase "y is 1" with a semicolon -- ; --.

Column 3, lines 13-23; Column 13, lines 3-13; and Column 14, lines 1-10, in the formula change "$OR^{3}$" to -- $R^{3}$ – so that in each case the correct formula is

UNITED STATES PATENT AND TRADEMARK OFFICE

CERTIFICATE OF CORRECTION

PATENT NO. : 5,830,243

DATED : November 3, 1998

INVENTOR(S) : Thomas J. Wolak et al.

It is certified that error appears in the above-identified patent and that said Letters Patent is hereby corrected as shown below:

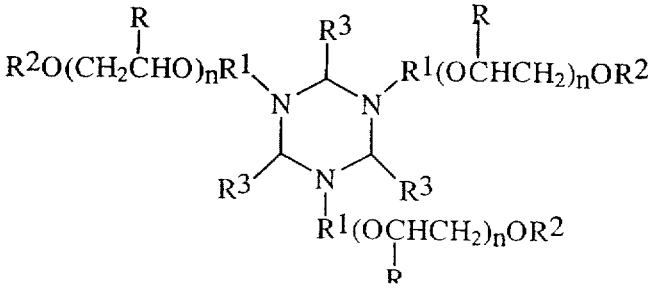

Signed and Sealed this

Seventh Day of September, 1999

*Attest:*

Q. TODD DICKINSON

*Attesting Officer*

*Acting Commissioner of Patents and Trademarks*